US005884441A

United States Patent [19]

Monroe, Jr. et al.

[11] Patent Number: 5,884,441

[45] Date of Patent: Mar. 23, 1999

[54] ART GLASS DISPLAY

[76] Inventors: James L. Monroe, Jr., 673 S. Everett Ave., Columbus, Ohio 43213; Michael D. Monroe, 3480 High Creek Dr., Columbus, Ohio 43223; Jeffrey J. Menhart, 1420 Brittany La., Columbus, Ohio 43220

[21] Appl. No.: 946,908

[22] Filed: Oct. 9, 1997

[51] Int. Cl.[6] ..... E06B 3/66

[52] U.S. Cl. ..... 52/204.59; 52/734.2; 52/656.9; 52/308; 52/204.61; 428/38

[58] Field of Search ..... 52/204.59, 204.61, 52/204.57, 307, 308, 656.8, 656.9, 314, 734.2; 428/38

[56] References Cited

U.S. PATENT DOCUMENTS

| | | | |
|---|---|---|---|
| 991,847 | 5/1911 | Henderson | 52/734.2 X |
| 3,460,303 | 8/1969 | Algrain et al. | 52/734.2 X |
| 3,512,320 | 5/1970 | Ferron et al. | 52/204.59 X |
| 4,068,441 | 1/1978 | Shaffer | 52/308 |
| 4,518,446 | 5/1985 | Drennan | 52/204.59 X |
| 4,619,850 | 10/1986 | Charlton | 428/38 |
| 4,723,388 | 2/1988 | Zieg | 52/656.8 X |
| 5,134,004 | 7/1992 | Moline | 428/38 |
| 5,274,976 | 1/1994 | Burkhart | 52/656.9 X |
| 5,456,048 | 10/1995 | White | 52/204.61 |

*Primary Examiner*—Carl D. Friedman
*Assistant Examiner*—Winnie S. Vip
*Attorney, Agent, or Firm*—Kremblas, Foster, Millard & Pollick

[57] ABSTRACT

An art glass display formed primarily of a framework, at least one protective sheet of a translucent material adjacent the framework, and a peripheral border in contact with a portion of the framework and the translucent material. The framework is comprised of a plurality of cames and connectors in interconnected relationship. The cames are formed having a first sidewall portion, a second sidewall portion, and a pair of grooves extending the length of each came intermediate the first sidewall portion and the second sidewall portion, with the grooves being on opposite sides of the came. The connectors are formed having a center section, and a plurality of arms. The center section has a notch formed therein. The framework has retained therein at least one pane of glass, each pane of glass being approximately 3.1 mm (⅛") thick and having a bevelled edge. The bevelled edge has its peripheral edge retained in the came grooves of those cames directly adjacent the pane of glass, and with the peripheral edge of the bevelled pane being further retained in the notch of each connector directly adjacent the pane of glass.

20 Claims, 7 Drawing Sheets

Prior Art I

Prior Art IV

Prior Art III

Prior Art II

ART GLASS DISPLAY

FIELD OF THE INVENTION

This invention relates to an art glass display which can be used in the fabrication of doors, tables, or other decorative displays featuring art glass, and more particularly to one which features dual-pane construction.

BACKGROUND OF THE INVENTION

Art glass displays have existed for centuries. Among the earliest forms of this type of art were stained glass windows made famous, for example, in the medieval cathedrals of Europe. Originally, art glass displays were fabricated by placing solder between the edges of adjacent pieces of art glass. As the solder cooled, the pieces of art glass were retained in fixed relationship to one another. With stained or colored art glass, the glass was ⅛" rolled glass.

Over the centuries, art glass was incorporated into the building of homes, especially those associated with the Victorian era. For the purposes of this invention, art glass refers to sheet glass which is tinted or colored, as well as to glass which may have a textured surface as opposed to just a smooth one, or to glass which is bevelled.

Furthermore, during the Victorian era, the use of bevelled glass came into vogue. Consequently, many ornate Victorian homes incorporated at least one, if not all three, embodiments of art glass. However, due to the nature of bevelling, it was not done on glass as thin as ⅛". Instead, glass that was at least 3⁄16" thick was used.

With the passing of time, there were improvements associated with the manufacture of art glass displays. The first improvement came along as the various pieces of art glass were cut so as to have straight edges, thus allowing the use of cames between the edges of adjacent pieces of art glass. Cames originally were elongated pieces of metal provided with channels on their opposite sides, into which channels the adjacent pieces of glass would fit.

Over the past couple of decades there has been an increase in the desire to incorporate the use of art glass in the construction of homes and furniture. Consequently, home builders and furniture manufacturers have responded to this demand by providing numerous products which feature art glass. This increased demand has resulted in a market for insulated glass products in North America of 90 million per year. These products include table tops, wall decorations, and art glass windows provided in both doors and as stand-alone window units. The bevelled art glass typically used in these applications still remains at least 1⁄16" thick.

Concerns over the structural integrity of art glass windows, specifically their air tightness and breakability, prompted fabricators of art glass displays to place a sheet of protective glass or plastic adjacent the art glass display sheet. Typically, this protective sheet, in the case of doors or windows, is on the outside of the door or window to be protected. However, this "improvement" significantly increased the cost of such displays, in addition to significantly increasing their weight.

In an attempt to solve the above problems, cames were developed which were lighter in weight. These cames could be made from extruded sheet-metal profiles, such as aluminum, or from plastic, and attached to connecting elements, which connecting elements retained a plurality of cames in the framework of the display. However, the weight of the finished art glass display could cause the assemblage of cames to fail structurally. To provide additional support for the framework holding the art glass, one solution engaged in by some artisans was to incorporate a second sheet of glass into the display, such that the art glass in its framework was sandwiched between the protective sheets. Unfortunately, although this solution enhanced the insulative capabilities of the window, not to mention aiding in the support of the art glass, it greatly increased the weight of the total display, not to mention the cost.

An alternative solution was proffered whereby the presence of art glass adjacent to the cames was eliminated, resulting in an artistic-looking came framework placed adjacent a sheet of glass. Unfortunately, the aesthetics associated with having glass in the framework had to be sacrificed. Moreover, since this "improvement" would sometimes result in a came framework which could become detached from itself, some manufacturers added a second piece of glass to the display, such that the empty came framework was effectively sandwiched between the two sheets of glass. Once again, there were the problems with weight and cost.

From the foregoing discussion it can be appreciated that current art glass displays are very expensive, and that they are made even more so if dual-pane construction is used. It is thus apparent that the need exists for an improved art glass display featuring dual-pane construction.

SUMMARY OF THE INVENTION

In accordance with this invention an art glass display is provided. The structure of this invention is formed primarily of a framework, at least one protective sheet of a translucent material adjacent the framework, and a peripheral border in contact with a portion of the framework and the translucent material. The framework is comprised of a plurality of cames and connectors in interconnected relationship. The cames are formed having a first sidewall portion, a second sidewall portion, and a pair of grooves extending the length of each came intermediate the first sidewall portion and the second sidewall portion, with the grooves being on opposite sides of the came. The connectors are formed having a center section, and a plurality of arms. The center section has a notch formed therein.

The framework has retained therein at least one pane of glass, each pane of glass being approximately 3.1 mm (⅛") thick and having a bevelled edge. The bevelled edge has its peripheral edge retained in the came grooves of those cames directly adjacent the pane of glass, and with the peripheral edge of the bevelled pane being further retained in the notch of each connector directly adjacent the pane of glass.

The bevelled edge of each pane of glass is of a width of between 9 and 14 mm, and more preferably of a width of 11 mm (7⁄16"). The peripheral edge of each bevelled pane is of a thickness of approximately 0.9 mm (1⁄25"). The cames are fabricated as roll-form tubes. In one preferred embodiment of the invention, the peripheral border comprises a desicant-filled spacer material, such as a foam with adhesive applied to two of its edges, and hot melt gray mastic. In another embodiment of the invention, the peripheral border comprises a tape, polysulfite and hot melt butyl. Preferably, the art glass display made in accordance with this invention includes two protective sheets of a translucent material, with the framework being between the two sheets.

There is also disclosed an art glass display formed primarily of a framework, at least one protective sheet of a translucent material adjacent the framework, and a peripheral border in contact with a portion of the framework and the translucent material. The framework is comprised of a plurality of cames and connectors in interconnected relationship. The cames are fabricated as roll-form tubes having a first sidewall portion, a second sidewall portion, and a pair of grooves extending the length of each came intermediate the first sidewall portion and the second sidewall portion, with the grooves being on opposite sides of the came. The connectors are formed having a center section, and a plurality of arms. The center section has a notch formed therein.

The framework has retained therein at least one pane of glass, each pane of glass being approximately 3.1 mm (⅛") thick and having a bevelled edge. The bevelled edge has its peripheral edge retained in the came grooves of those cames directly adjacent the pane of glass, and with the peripheral edge of the bevelled pane being further retained in the notch of each connector directly adjacent the pane of glass.

The bevelled edge of each pane of glass is of a width of between 9 and 14 mm, and more preferably of a width of 11 mm (7⁄16"). The peripheral edge of each bevelled pane is of a thickness of approximately 0.9 mm (1⁄25"). In one preferred embodiment of the invention, the peripheral border comprises a desicant-filled spacer material, such as a foam with adhesive applied to two of its edges, and hot melt gray mastic. In another embodiment of the invention, the peripheral border comprises a tape, polysulfite and hot melt butyl. Preferably, the art glass display made in accordance with this invention includes two protective sheets of a translucent material, with the framework being between the two sheets.

There is also disclosed a component for an art glass display formed primarily of a framework comprised of a plurality of cames and connectors in interconnected relationship, and a pane of glass. The cames are fabricated as roll-form tubes having a first sidewall portion, a second sidewall portion, and a pair of grooves extending the length of each came intermediate the first sidewall portion and the second sidewall portion, with the grooves being on opposite sides of the came. The connectors are formed having a center section, and a plurality of arms. The center section has a notch formed therein.

The pane of glass is approximately 3.1 mm (⅛") thick and has a bevelled edge. The bevelled edge has its peripheral edge retained in the came grooves of those cames directly adjacent the pane of glass, and with the peripheral edge of the bevelled pane being further retained in the notch of each connector directly adjacent the pane of glass. The bevelled edge of the pane of glass is of a width of between 9 and 14 mm, and more preferably of a width of 11 mm (7⁄16"). The peripheral edge of the bevelled pane is of a thickness of approximately 0.9 mm (1⁄25").

The primary objective of this invention is to provide an improved art glass display featuring dual-pane construction.

Another objective of this invention is to provide an improved art glass display that is relatively light in weight, so as to be easier to install.

These and other objects and advantages of this invention will be readily apparent from the following detailed description of an illustrative embodiment thereof, the accompanying drawings, and the appended claims.

DETAILED DESCRIPTION OF THE INVENTION

Figure 1:
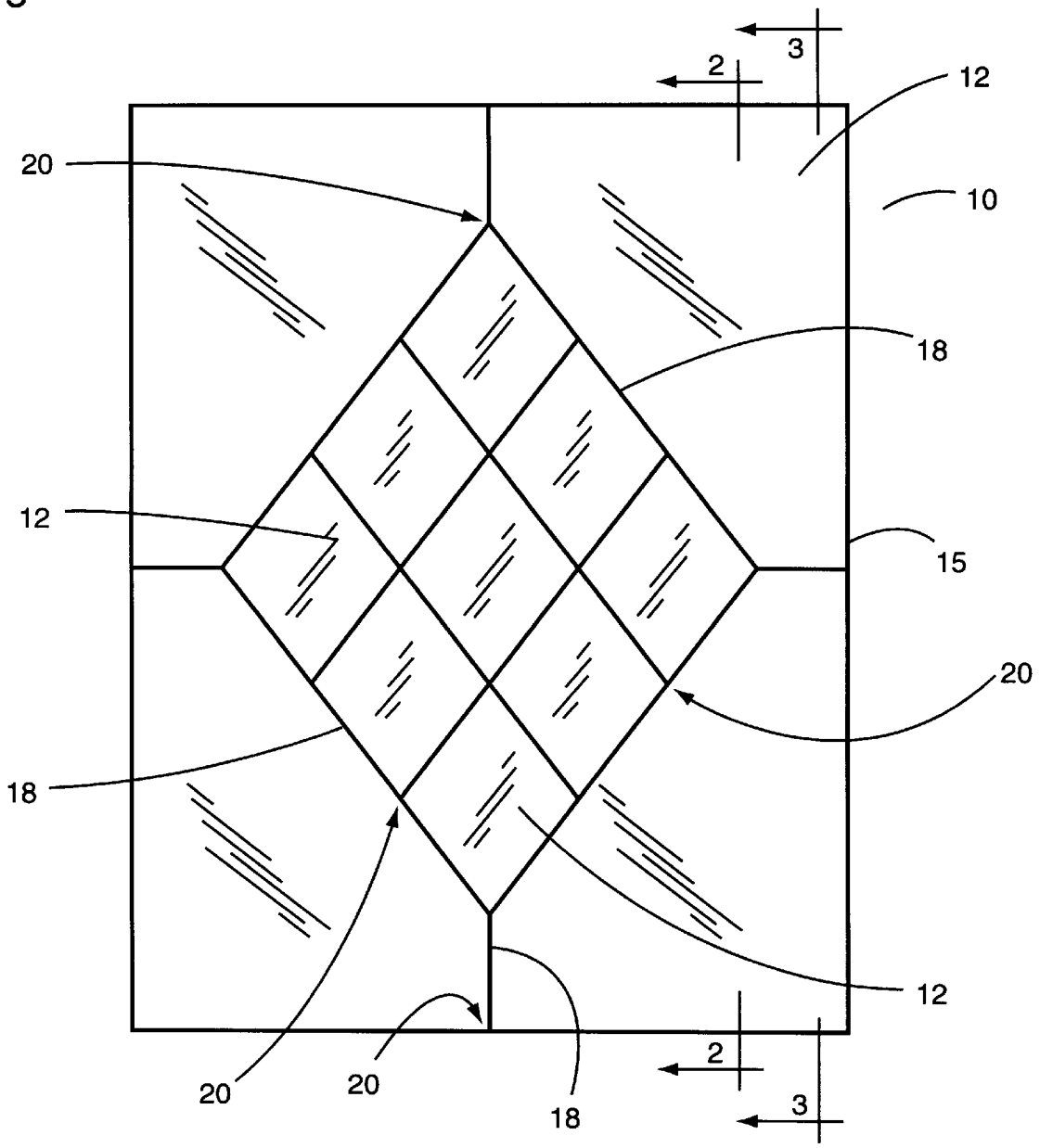
FIG. 1. discloses a front elevational view of a first prior art embodiment of an art glass display.

Having reference to the drawings, attention is directed first to FIG. 1 which shows a first embodiment of an art glass display made in accordance with the prior art, with this art glass display of the prior art being designated generally by the numeral 10. As can be best appreciated from FIG. 1, this type of art glass display has a number of key components such as a plurality of glass panes 12 which were retained within a peripheral border 15. Each of the glass panes 12 was held in place by a plurality of mounting elements typically known as cames 18. The mounting elements in this type of prior art display may have been solder or they have been preformed lead channels into which the 3.1 mm (⅛") thick rolled art glass, typically colored or stained glass was placed. If the type of art glass was bevelled, then the glass originally was at least as thick as 4.6 mm (3⁄16") such that the bevelled peripheral edge of the pane 12 would have been 3.1 mm (⅛") thick. The mounting elements 18 were held more securely in place in the art glass display 10 by a plurality of connecting elements 20, which in some cases were solder and in subsequent years developed into connecting elements which mechanically inter-engaged with the mounting elements.

Figure 2:
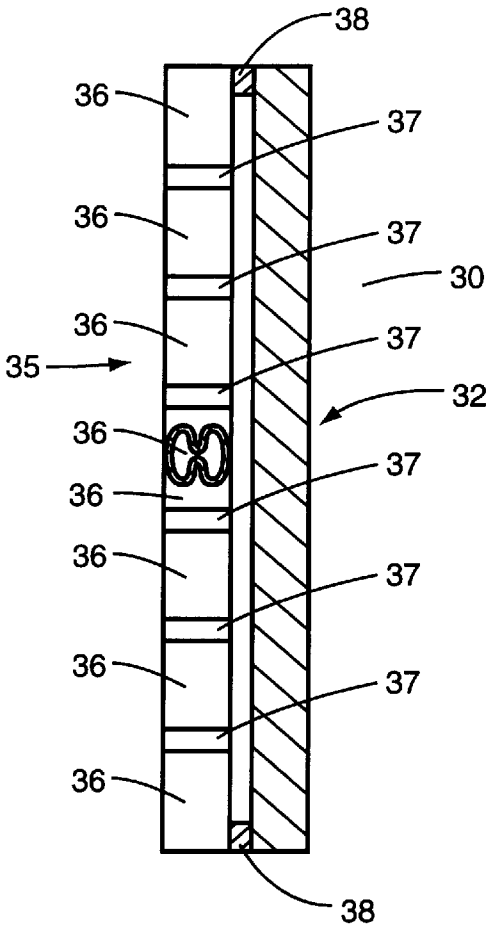
FIG. 2 discloses a vertical sectional view taken along line 2—2 of FIG. 1, but of a second prior art embodiment of an art glass display.

Turning now to FIG. 2, there is disclosed a second art glass display of prior art designated generally by the numeral 30. While FIG. 1 has designated thereon line 2—2, it should be appreciated that the prior art display shown in FIG. 1 consisted of a single sheet of an art glass display 10, whereas it would be readily appreciated that FIG. 2 is comprised of two "sheets", with one being an insulative glass pane 32. While the other is the decorative frame 35 which decorative frame 35 would be equivalent to the art glass display shown in FIG. 1. The second art glass display 30 incorporates the type of display shown in FIG. 1, but more importantly adds a protective sheet of either glass or plastic 32. The addition of this insulative sheet 32 provides better resistance to air as well as providing protection for the decorative frame against breakage.

As was the case with the art glass display of FIG. 1, the art glass display of FIG. 2 also is formed with its glass retained within the decorative frame by a plurality of cames 36 and connectors 37. A spacer material, such as a grooved tape 38, applied using the hot press technique extends around the peripheral edges of the protective sheet 32 and decorative frame 35 respectively.

Figure 3:
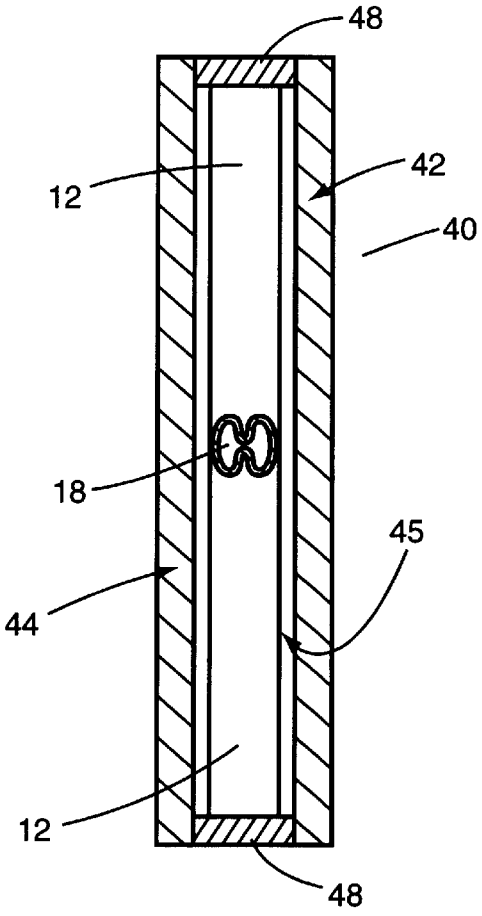
FIG. 3 discloses a vertical sectional view taken along line 3—3 of FIG. 1, but of a third prior art embodiment of an art glass display.

To provide additional insulative properties as well as greater protection for the decorative art glass panes, a third embodiment of prior art displays is shown in FIG. 3. In this particular embodiment of the prior art, it will be appreciated that there is a first protective sheet 42 and a second protective sheet 44 with both protective sheets being on opposite sides of the decorative frame 45. Furthermore, it should be appreciated that while the vertical sectional view of FIG. 3 is shown as being taken along 3—3 of FIG. 1, it should be appreciated that the prior art embodiment of FIG. 1 does not incorporate the dual-pane concept shown in the later developed prior art embodiment of FIG. 3. It should also be appreciated that each of the prior art embodiments of FIGS. 1, 2 and 3 all have glass panes directly adjacent both sides of every came. This is done in order to provide structural integrity for each respective decorative frame. It should also be noted that FIG. 3 includes a spacer material 48 which is in contact with all the peripheral edges of the protective sheets and decorative frame 42, 44, and 45 respectively.

Figure 4:
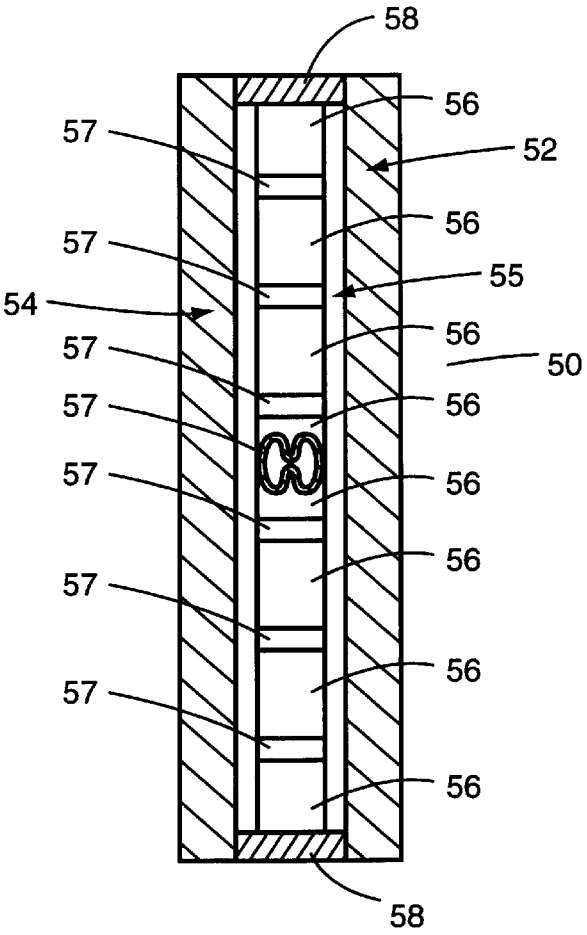
FIG. 4 discloses a vertical sectional view similar to FIG. 2, but of a fourth prior art embodiment of an art glass display.

Due to the increase in weight of the prior art embodiment shown in FIG. 3 from that shown in either of FIGS. 1 and 2, a fourth prior art embodiment 50 of an art glass display was developed as shown in FIG. 4, which embodiment provided for dual-pane construction with first protective glass sheet 52 and a second protective sheet 54. However, in order to lighten the overall art glass display 50 the individual art glass panes were eliminated from the decorative frame 55. Thus, the decorative frame 55 merely incorporated cames 56 and connectors 57, albeit often these were anodized or powder coated in appearance, thereby tending to be aesthetically pleasing. Once again a spacer material 58 such as a grooved tape, extended along the peripheral edges of the protective sheets and decorative frame 52, 54, and 55 respectively and was typically applied thereto using the hot press technique.

Figure 5:
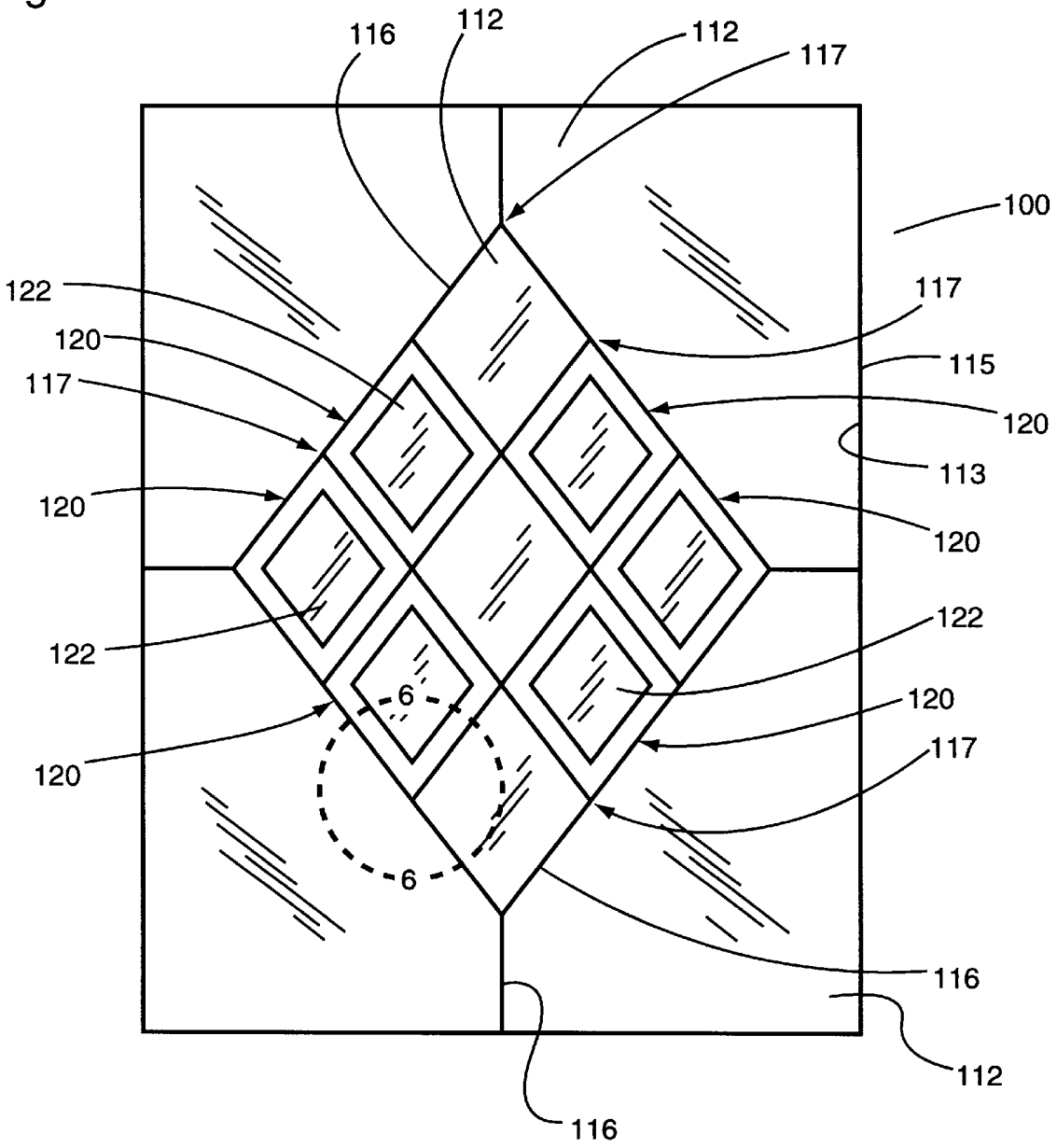
FIG. 5 discloses a front elevational view of an art glass display made in accordance with the present invention.

In an effort to solve the problems associated with the prior art, the aesthetic beauty of art glass effectively needed to be sacrificed in order to provide a decorative glass display incorporating dual-pane construction. The solution to the problem is found in the improved art glass display of this invention shown in FIG. 5 and designated generally by the numeral 100. In this particular art glass display, a pair of protective sheets, which could be either glass or plastic, are provided as part of the dual-pane construction. A spacer material 113 and either hot melt gray mastic 115 or in the alternative a combination of polysulfite and hot melt butyl are provided so as to double insulate the art glass display 100 by providing what is known as a secondary seal.

Figure 6:
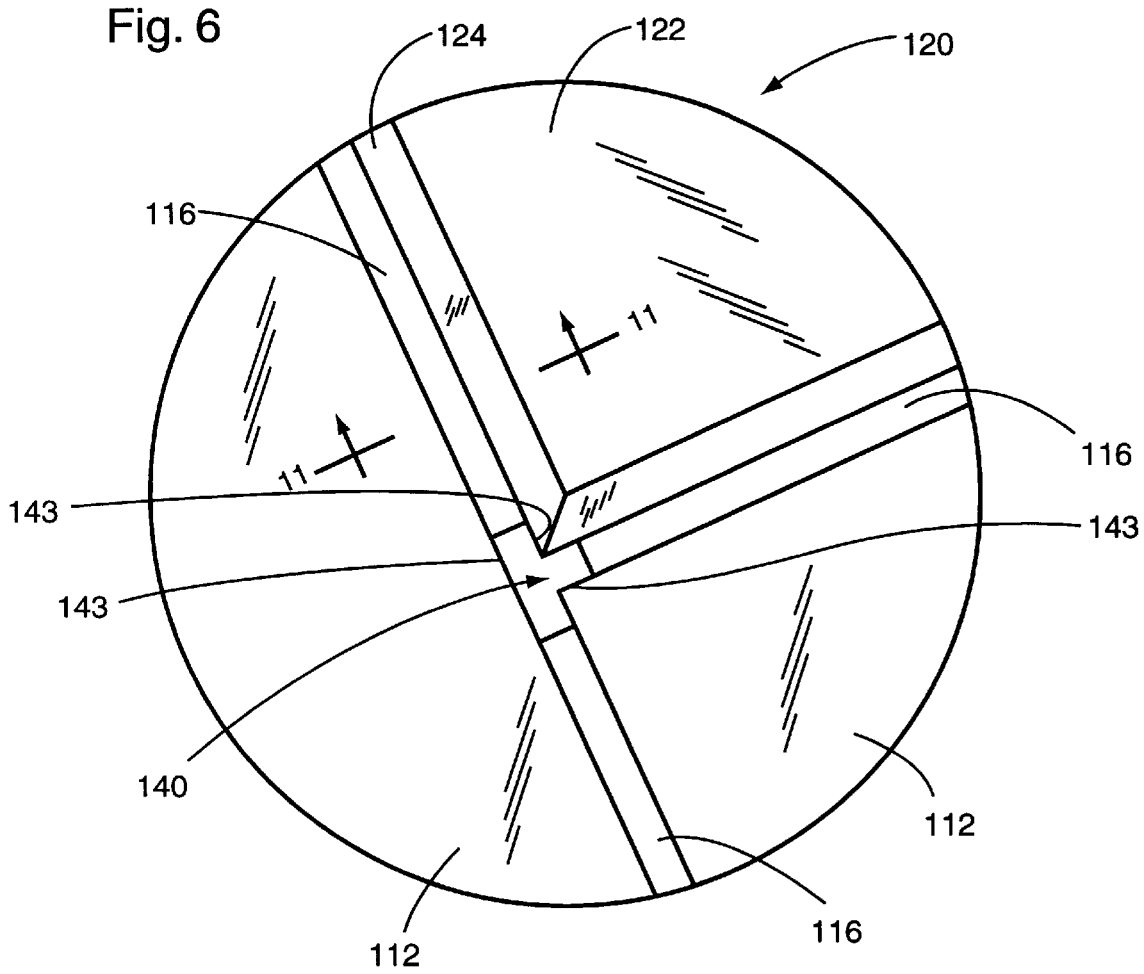
FIG. 6 discloses a front elevational view on a greatly enlarged scale of the area within line 6—6 of FIG. 5.

It will be appreciated that there are a plurality of interconnected cames 116 and connectors 117 which form a framework similar to that shown in the other prior art embodiments. However, a distinctive feature of this particular art glass display is that art glass panes 120 are not retained directly adjacent every came 116. This can best be appreciated from a comparison of FIGS. 5 and 6 which discloses six art glass panes 120 being retained within the framework of the cames and connectors 116 and 117 respectively. It will be noted that each of the art glass panes 120 associated with this invention include a center section 122 as well as a bevelled edge portion 124. The thickness of the art glass panes 120 associated with this invention are at least ⅛" thick. Furthermore, they have a bevelled portion having a width of between 9–14 mm, and more preferably 11 mm (7/16"). Preferably the angle at which the glass is bevelled is 9°. Along the peripheral edge of the bevelled edge portion 124, the thickness of the glass is approximately 0.9 mm (1/25"). The thickness of the glass at the peripheral edge of the bevelled edge portion is also referred to as the remaining edge thickness.

Figure 7:
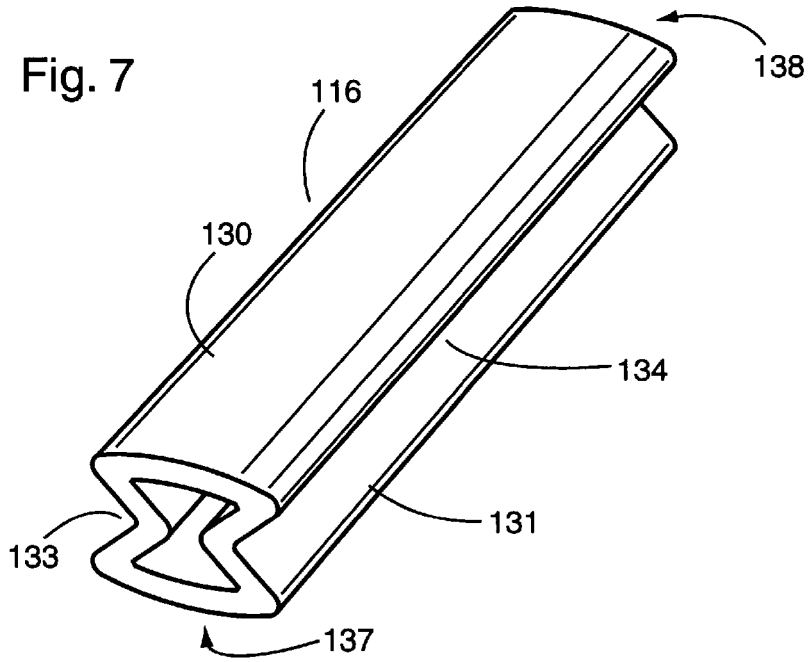
FIG. 7 discloses a perspective view of a came associated with the present invention.

In the preferred embodiment of the invention the cames 116 which are used in the framework of the art glass display can be better appreciated from FIG. 7. It will be noted that each came includes a first sidewall portion 130 and a second sidewall portion 131 both of which are rounded. The two sidewall portions are separated from each other by a pair of grooves 133, 134 which extend from the first end 137 to the second end 138 of each came 116. The width of each groove is too narrow to accommodate a peripheral edge of a glass pane where the peripheral edge is 3.1 mm (⅛") thick. It should also be noted that grooves 133 and 134 are on opposite sides of each came. The cames are preferably a roll-formed tube with a laser weld.

Figure 10:
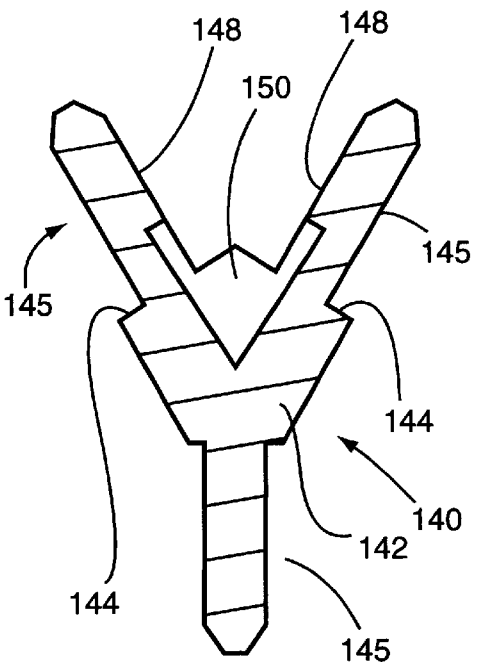
FIG. 10 discloses a vertical sectional view taken along line 10—10 of FIG. 9.
Figure 9:
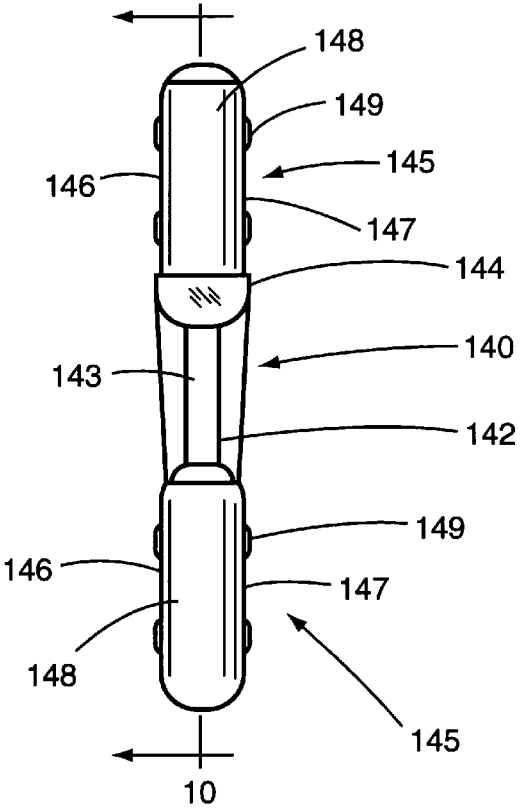
FIG. 9 discloses a side elevational view of a connector associated with the present invention.
Figure 8:
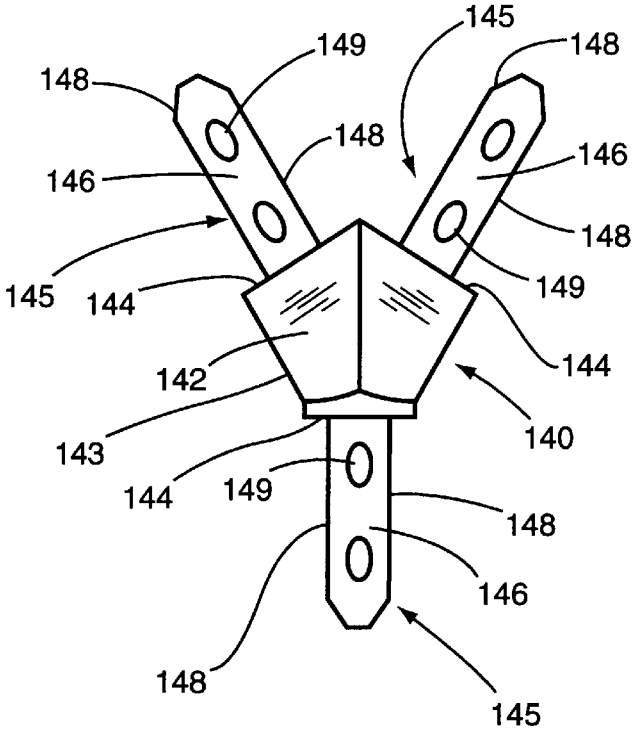
FIG. 8 discloses a front elevational view of a connector associated with the present invention.

The connectors 140 used with the cames of this invention can best be appreciated from a comparison of FIGS. 8, 9 and 10. Although the form of connector shown is that of a Y-connector, it should be understood that the connectors could be in various geometric patterns such as X, T, +, or other variations, which could result in various shapes of art glass panes being used. In general, the connectors 140 include a center section 142 having at least two side edge walls 143, preferably in a rectangular, planar configuration. Additionally, each center section 142 has a plurality of end surfaces 144, all of which are preferably planar, and in the embodiment of connector 140 shown in FIGS. 8, 9 and 10, the number of such end surfaces 144 is three. Projecting from the center section 142 are a plurality of arms 145, which in the embodiment of the connector shown in FIGS. 8, 9 and 10 is three. Each arm 145 has a sidewall portion engaging wall 146, 147 as well as a groove engaging wall 148. Each of the sidewall portions engaging walls 146 and 147 preferably have protruding therefrom nubs 149. Additionally, a drop of an adhesive is placed inside each came so as to come into contact with an arm of a connector, thereby providing for a mechanical as well as a chemical bond. The adhesive should be one which bonds metal and plastic together, such as an epoxy resin. One final important feature of the connector associated with this invention is a notch 150 shown best in FIG. 10 which extends partially through portions of adjacent arms 145 as well as a portion of the center section 142. The notch 150 permits the sharp comers of the art glass panes to be disposed therein.

Figure 11:
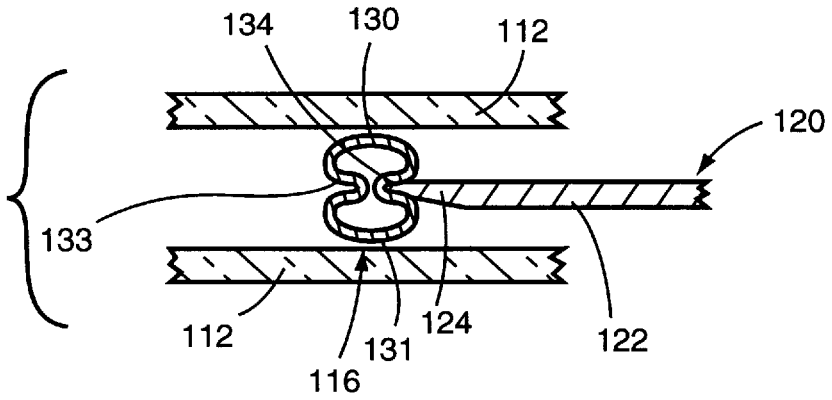
FIG. 11 discloses a vertical sectional view on an enlarged scale taken along line 11—11 of FIG. 6.

In the preferred embodiment of the invention, a portion of which can be appreciated from FIG. 11, the protective sheets 112 are located on opposite sides of the frame work which contains art glass panes 120 the peripheral edge of the bevelled edge portion 124 extending within a groove of each came. The two protective sheets 112 preferably are not in physical contact with the framework, more particularly the cames 116 and/or connectors 117.

Figure 12:
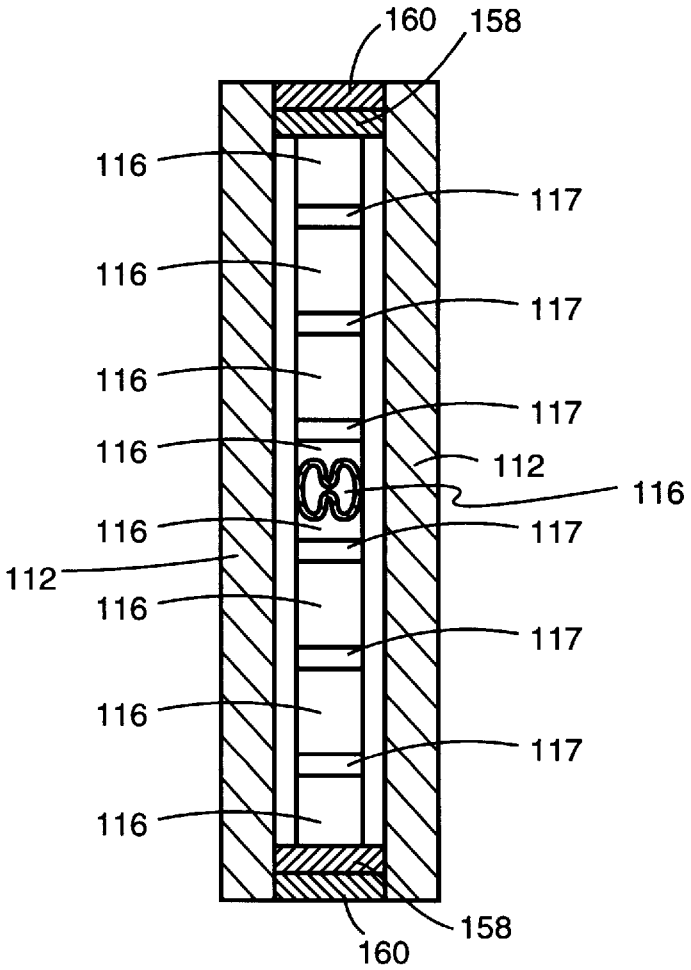
FIG. 12 discloses a vertical sectional view similar to FIG. 4, but of an art glass display made in accordance with the present invention.
Figure 13:
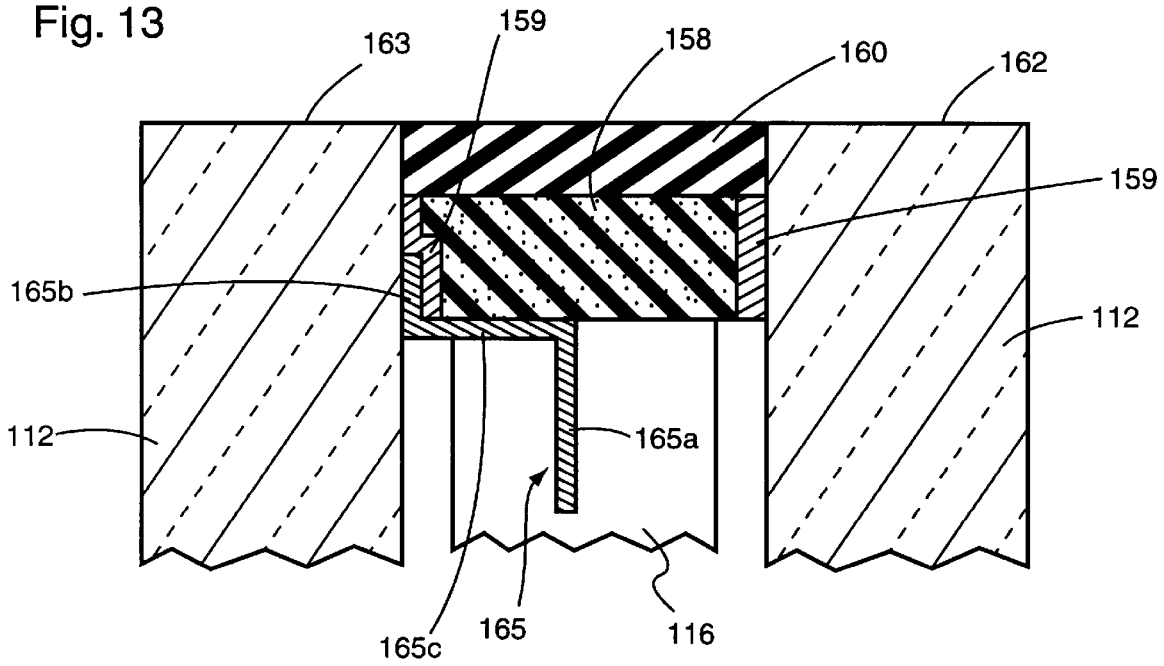
FIG. 13 discloses a partial vertical sectional view on a greatly enlarged scale taken at the horizontal centerline of the display shown in FIG. 5.

In actual use, the protective sheets 112 and framework for the art glass panes 120 are assembled in one embodiment as is shown in a comparison of FIGS. 12 and 13. During the assembly of this embodiment of the invention having two protective sheets, a first protective sheet has spacer material 158, with an adhesive material 159 applied to its two edge surfaces, placed around adjacent the first sheet's peripheral edge 162, such that a first edge of the tape adheres to the surface of the protective sheet. Then the various components of the art glass display are assembled into the final form of the lattice associated with the design of framework desired. This assembly includes inserting the appropriate clips 165 into the cames 116, which clips 165 are then secured to the adhesive on the second edge of the spacer material. Preferably no adhesive is applied either to the clip or to the inside of the came, thus permitting some movement of the came along the clip due to temperature fluctuations in the airspace between the protective sheets.

Preferably then, a butterfly press with suction cups is used to place the second protective sheet into contact with the adhesive on the second edge of the spacer material, such that the two are secured adjacent the second sheet's peripheral edge 163. The presence of the second protective sheet assists in maintaining the position of the clip 165 on the adhesive 159. It should also be noted that in this embodiment of the invention the clip is a simple clip having two arms 165*a* and 165*b* disposed perpendicularly to a middle connecting segment 165*c*. Preferably the two arms 165*a* and 165*b* are parallel to one another, but extend in opposite directions from the middle connecting segment 165*c*.

It will be noted that in the embodiment of this invention disclosed in FIG. 12, the peripheral edges of the art glass display are insulated both with the spacer material 158, which is preferably a desicant-filled foam with adhesive applied to two of its edges, and either hot melt gray mastic or polysulfite and a butyl hot melt 160. An example of a desicant-filled spacer material with adhesive applied to two of its edges is a foam tape sold by Edgetech, which tape also has mylar attached to the outside of the tape, such that the mylar acts as a vapor barrier.

Figure 14:
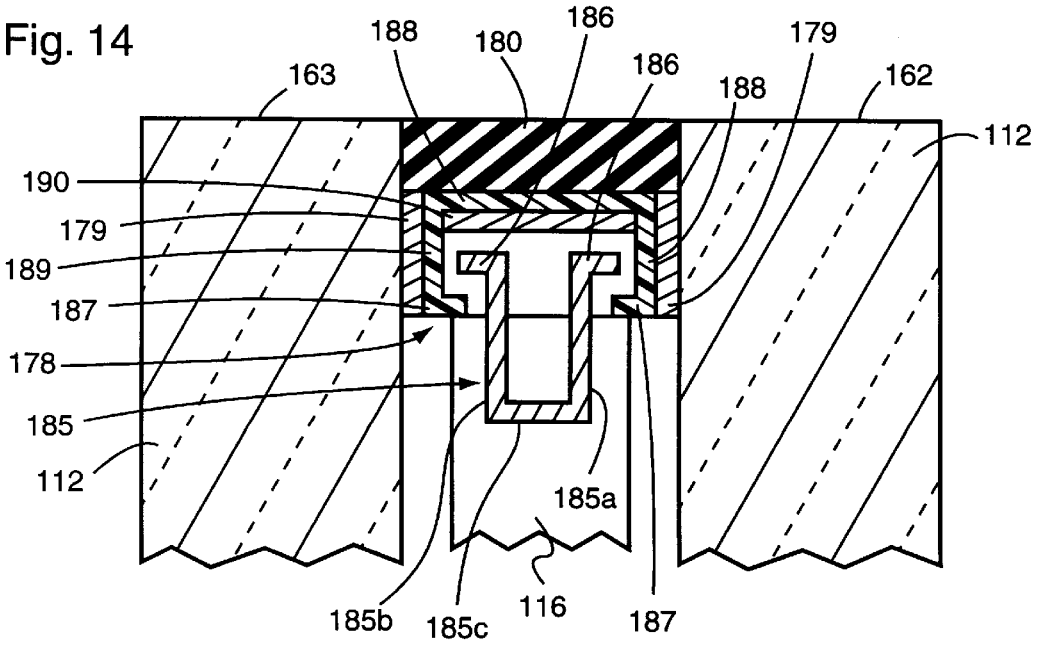
FIG. 14 discloses a partial vertical sectional view on a greatly enlarged scale taken at the horizontal centerline of the display shown in FIG. 5., featuring an alternative spacer material.

Another embodiment of a spacer material is disclosed in FIG. 14. In this embodiment, the spacer material 178 resembles a C-shaped channel, with adhesive material 179 applied to its two edge surfaces. Once again the spacer material is positioned adjacent the first sheet's peripheral edge 162, such that a first edge of the spacer material adheres to the surface of the protective sheet. Thereafter, the various components of the art glass display are assembled into the final form of the lattice associated with the design of framework desired. This assembly includes inserting the appropriate clips 185 into the cames 116, with the opposite ends 186 of clips 185 being secured by spring bias within the channel of the spacer material. Once again, no adhesive is applied either to the clip or to the inside of the came, thus permitting some movement of the came along the clip due to temperature fluctuations in the airspace between the protective sheets.

Preferably then, a butterfly press with suction cups is used to place the second protective sheet into contact with the adhesive on the second edge of the spacer material, such that the two are secured adjacent the second sheet's peripheral edge 163. Once again, either hot melt gray mastic or polysulfite and a butyl hot melt 180 is applied to the outer surface of the spacer material 178 between the two protective sheets.

In this embodiment of the invention the clip 185 has two arms 185*a* and 185*b* disposed intermediate clip ends 186 and a connecting segment 165*c*. Preferably the two arms 185*a* and 185*b* are parallel to one another, and extend perpendicularly from the middle connecting segment 185*c*. It will also be noted that in the embodiment of the invention shown in FIG. 14, the clip ends 186 are parallel to the middle connecting segment 185*c*. The clip ends are inserted into the spacer channel by squeezing together the arms of the spring clip, so as to permit the ends to pass between the pair of spacer front walls 187. The C-shaped channel also has a rear wall 188, with the front wall surfaces 187 being attached to the rear wall 188 by a pair of side walls 189. A desicant material 190 is placed inside the C-shaped channel either on or adjacent the rear wall 188.

Thus, it is readily apparent, from the foregoing detailed description of the invention, that a particularly novel and extremely utilitarian art glass display is provided. In particular, an art glass display is provided using cames not ordinarily designed to hold glass. Also, unique components useful in the assembling of art glass display are provided.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. An art glass display comprising, a framework, said framework being comprised of a plurality of cames and connectors in interconnected relationship, said cames formed having a first sidewall portion, a second sidewall portion, and a pair of grooves extending the length of each came intermediate said first sidewall portion and said second sidewall portion, with said grooves being on opposite sides of said came, said connectors formed having a center section, a plurality of arms, said arms connected to the ends of said cames, said center section having a notch formed therein, said framework having retained therein at least one pane of glass having a bevelled edge, said bevelled edge having its peripheral edge being retained in the came grooves of those cames directly adjacent said pane of glass, said peripheral edge of said bevelled pane being further retained in the notch of each connector directly adjacent said pane of glass, at least one protective sheet of a translucent material adjacent said framework, and a peripheral border in contact with a portion of said framework and said translucent material.

2. The art glass display according to claim 1 wherein said pane of glass is approximately 3.1 mm thick.

3. The art glass display according to claim 1 wherein said bevelled edge is of a width of between 9 and 14 mm.

4. The art glass display according to claim 1 wherein said peripheral edge of said pane of glass is of a thickness of approximately 0.9 mm.

5. The art glass display according to claim 1 wherein said peripheral border comprises a spacer material and hot melt gray mastic.

6. The art glass display according to claim 1 wherein said peripheral border comprises a spacer material, polysulfite and hot melt butyl.

7. The art glass display according to claim 1 wherein said peripheral border is attached to a came by a clip.

8. The art glass display according to claim 1 which includes two protective sheets of a translucent material, said framework being between said two sheets.

9. An art glass display comprising, a framework, said framework being comprised of a plurality of cames and connectors in interconnected relationship, said cames fabricated as roll-form tubes formed having a first sidewall portion, a second sidewall portion, and a pair of grooves extending the length of each came intermediate said first sidewall portion and said second sidewall portion, with said grooves being on opposite sides of said came, said connectors formed having a center section, a plurality of arms, said arms connected to the ends of said roll-form tubes of said canes, said center section having a notch formed therein, said framework having retained therein at least one pane of glass, each pane of glass being approximately ⅛" thick and having a bevelled edge, said bevelled edge having its peripheral edge being retained in the came grooves of those cames directly adjacent said pane of glass, said peripheral edge of said bevelled pane being further retained in the notch of each connector directly adjacent said pane of glass, at least one protective sheet of a translucent material adjacent said framework, and a peripheral border in contact with a portion of said framework and said translucent material.

10. The art glass display according to claim 9 wherein said bevelled edge is of a width of between 9 and 14 mm.

11. The art glass display according to claim 9 wherein said peripheral edge of said pane of glass is of a thickness of approximately 0.9 mm.

12. The art glass display according to claim 9 wherein said peripheral border comprises a spacer material and hot melt gray mastic.

13. The art glass display according to claim 9 wherein said peripheral border comprises a spacer material, polysulfite and hot melt butyl.

14. The art glass display according to claim 9 wherein said peripheral border is attached to a came by a clip.

15. The art glass display according to claim 9 which includes two protective sheets of a translucent material, said framework being between said two sheets.

16. A device for an art glass display comprising, a framework, said framework being comprised of a plurality of cames and connectors in interconnected relationship, said cames formed having a first sidewall portion, a second sidewall portion, and a pair of grooves extending the length of each came intermediate said first sidewall portion and said second sidewall portion, with said grooves being on opposite sides of said came, said connectors formed having a center section, a plurality of arms, said center section having a notch formed therein, and at least one pane of glass, each pane of glass having a bevelled edge, said bevelled edge having its peripheral edge being retained in the came grooves of those cames directly adjacent said pane of glass, said peripheral edge of said pane of glass being further retained in the notch of each connector directly adjacent said pane of glass.

17. The device according to claim 16 wherein each said pane of glass is approximately 3.1 mm thick.

18. The device according to claim 16 wherein said bevelled edge is of a width of between 9 and 14 mm.

19. The device according to claim 16 wherein said peripheral edge of each said pane of glass is of a thickness of approximately 0.9 mm.

20. The device according to claim 16 wherein each said pain of glass is bevelled at an angle of about 9°.

* * * * *